US006427982B1

(12) United States Patent
Sugimachi

(10) Patent No.: US 6,427,982 B1
(45) Date of Patent: Aug. 6, 2002

(54) HOIST APPARATUS

(75) Inventor: Hiroyuki Sugimachi, Saga (JP)

(73) Assignee: Toku Pneumatic Tool Mfg. Co., Ltd., Miyaki-gun (JP)

( * ) Notice: Subject to any disclaimer, the term of this patent is extended or adjusted under 35 U.S.C. 154(b) by 0 days.

(21) Appl. No.: 09/684,902

(22) Filed: Oct. 10, 2000

(30) Foreign Application Priority Data

Jul. 14, 2000 (JP) ..... 2000-214340

(51) Int. Cl.[7] ..... B66D 1/10
(52) U.S. Cl. ..... 254/360; 254/372
(58) Field of Search ..... 254/360, 372, 254/380

(56) References Cited

U.S. PATENT DOCUMENTS 3,933,388 A * 1/1976 Conboy ..... 254/360
3,960,362 A * 6/1976 Griffiths et al. ..... 254/360
4,462,571 A * 7/1984 Fox ..... 254/360
5,520,368 A * 5/1996 Braesch et al. ..... 254/360
5,725,199 A * 3/1998 Yamamoto ..... 254/360
5,848,781 A * 12/1998 Kulhavy et al. ..... 254/360
5,915,673 A * 6/1999 Kazerooni ..... 254/360
5,984,276 A * 11/1999 Green ..... 254/360

FOREIGN PATENT DOCUMENTS

CA 627562 * 9/1961 ..... 254/360

* cited by examiner

*Primary Examiner*—Emmanuel M. Marcelo
(74) *Attorney, Agent, or Firm*—Shanks & Herbert

(57) ABSTRACT

The hoist apparatus includes a chain for raising or lowering an object; an upper hook member; a hoist body member suspended by the upper hook member; a lower hook member for hoisting the object mounted to the hoist body member at a bottom end thereof for hoisting the object; a pneumatic motor disposed in the hoist body member for winding the chain up or down; and a control unit for driving or suspending the hoist body member; wherein a distance of the chain between the control unit and the lower hook member is set to be variable.

7 Claims, 7 Drawing Sheets

HOIST APPARATUS

CROSS-REFERENCE TO RELATED APPLICATION

The entire disclosure of Japanese Patent Application No. 2000-214340 filed on Jul. 14, 2000, including specification, claims and summary is incorporated by reference in its entirety.

BACKGROUND OF THE INVENTION

1. Field of the Invention

The present invention relates to a hoist apparatus and, more particularly, to a compact and small-sized hoist apparatus for hoisting an object, having a control unit disposed discretely and independently from a hoist body member and at a position close to and on the side of a lower hook member that hoists an object.

2. Description of the Related Art

There are various types of hoist apparatuses. A hoist apparatus of one type is a small-sized hoist machine having a hoist body member with a drum rotatable in both normal and opposite directions disposed therein and with a lower hook member for hooking and hoisting objects mounted on the bottom end thereof. A wire for raising or lowering objects is configured such that its top end is secured to the hoist body member at a predetermined position and its bottom end is connected to the drum so as to be wound up around the drum and wound down as the drum rotates. A control unit for controlling the rotational drive of the drum is disposed in the hoist body member.

As this hoist machine has the lower hook member for hooking and hoisting or releasing objects mounted on the hoist body member, the lower hook member is lowered together with the hoist body member by operating the control unit and winding the wire down. After the objects have been hooked and hoisted by the lower hook member or released therefrom, the lower hook member is raised together with the hoist body member by winding the wire up by means of the operation of the control unit. Once the lower hook member is raised to a predetermined position, then it may be transferred horizontally to a predetermined location and lowered by winding the wire down to a desired position for releasing or hooking and hoisting objects.

For this type of the hoist machine, the control unit is raised and lowered together with the lower hook member for hoisting objects so that this hoist machine is suitable for manual operation by the control unit within reach of an operator. Moreover, the lower hook member is disposed in the position close to the control unit so that even the manual operation for hooking or releasing objects can be carried out readily by raising or lowering the wire for hooking the objects. Therefore, this type of the hoist apparatus is particularly suitable for the operation of hoisting and transferring lightweight objects to a predetermined location.

This type of the hoist machine has the shortcomings, however, in that it uses a wire and the wire has to be exchanged at a relatively short interval due to its shorter life. Further, the hoist body member has to be disassembled for exchanges of wires. This renders the maintenance of the hoist machine difficult and laborious.

Moreover, the wire for use with this type of the hoist machine has to be short due to a small wire container in which the wire is wound and accommodated, so that the lift distance of the wire has to become so short. For this type of the hoist machine, the lift distance of the wire may be, for example, as short as about 2meters. In addition, the wire is wound around the drum in a form of plural loops such that an outer loop of the wire wound around the drum is wound and superimposed over an inner loop thereof. This configuration varies the speed of winding the wire up or down with the number of loops of the wire. In other words, the inner loop of the wire can be wound up faster than the outer loop thereof and the outer loop of the wound wire can be released faster than the inner loop thereof. This renders the operation of the hoist machine inconvenient because the wound wire cannot be lifted or lowered at a constant speed and the adjustment of the winding speed is rendered laborious and complicated in the operation of the hoist machine itself.

This conventional hoist machine has the lower hook member directly fixed on the hoist body member or arranged so as to swing in one direction only. Therefore, the lower hook member has to be swung in one direction or in another direction in order to allow the lower hook member to adapt to an eyebolt or other fixed-type hoisting jig and to hook it and hoist objects. Moreover, the lower hook member has to be operated together with the hoist body member so that this operation is very laborious and causes risk. This further renders the operability of the hoist apparatus poor as a whole.

In addition, for the hoist machine of this conventional type, the control unit is mounted integrally on the hoist body member so as to render the operation of the control unit easy by one hand, yet difficult and inconvenient for the operation when the operator has to manipulate it by the other hand. Furthermore, an exhaust outlet for gases from a pneumatic motor is generally disposed in the position close to the operator. This is hazardous to the health of the operator. Moreover, the close location of the exhaust outlet to the operator gives very noisy working conditions for the operator.

SUMMARY OF THE INVENTION

Therefore, the present invention has the object to solve the shortcomings of the conventional hoist machines and to achieve improvements in such conventional hoist machines as described above.

It is another object of the present invention to provide a hoist apparatus that can readily be operated so as for a hook member to hoist an object.

It is a further object of the present invention to provide a hoist apparatus that can readily be operated by an operator without paying much attention to the operator's location.

In order to achieve the objects, the present invention in a major aspect provides a hoist apparatus for hoisting an object, which includes a hoist body member having a pneumatic motor and a chain-winding wheel member such as a chain engagement member rotatable by the pneumatic motor, a chain having a top end and a bottom end for hoisting an object, the chain being wound up or down at a top end portion by the chain-winding wheel member rotated by the pneumatic motor to raise or lower the object to a predetermined position, a lower hook member for hooking and hoisting the object, the lower hook member being secured to the bottom end of the chain, and a control unit for driving or suspending the operation of the pneumatic motor; wherein the control unit is detachably connected to the chain at the position apart from the hoist body member and close to the lower hook member; and wherein a distance of the chain between the control unit and the lower hook member is set to be variable.

In a preferred embodiment of the present invention, the control unit for the hoist apparatus is disposed discretely and independently from the hoist body member and fixed to the chain so as to be movable around the chain. This embodiment provides the advantage that the control unit can be turned in a different direction so as to fail to interfere with the hooking of the object by the lower hook member, otherwise the position of the control unit would block the operation of the lower hook member for hooking the object or it would interfere with the operator's position upon operating the control unit for hooking or releasing the object.

In another preferred embodiment of the present invention, the control unit is provided with the operational switch through which the operator can turn the pneumatic motor on or off by one hand. In another preferred embodiment of the present invention, the control unit is arranged so as to shift the position in which its operational switch is located. That the position of the operational switch can be shifted so as to adapt to the position of an operator's preference can provide the operator with the readiness for operating the hoist apparatus.

In a further preferred embodiment, the control unit is composed of a chain-raising lever and a chain-lowering lever so that the direction of winding the chain can be quickly changed simply by shifting the lever's operation. In a still further preferred embodiment, the hoist apparatus of this invention can readily change the direction of winding the chain by the simple operation of depressing the lever.

Other objects, features and advantages will become apparent in the course of the description with reference to the accompanying drawings.

DETAILED DESCRIPTION OF THE INVENTION

Figure 1:
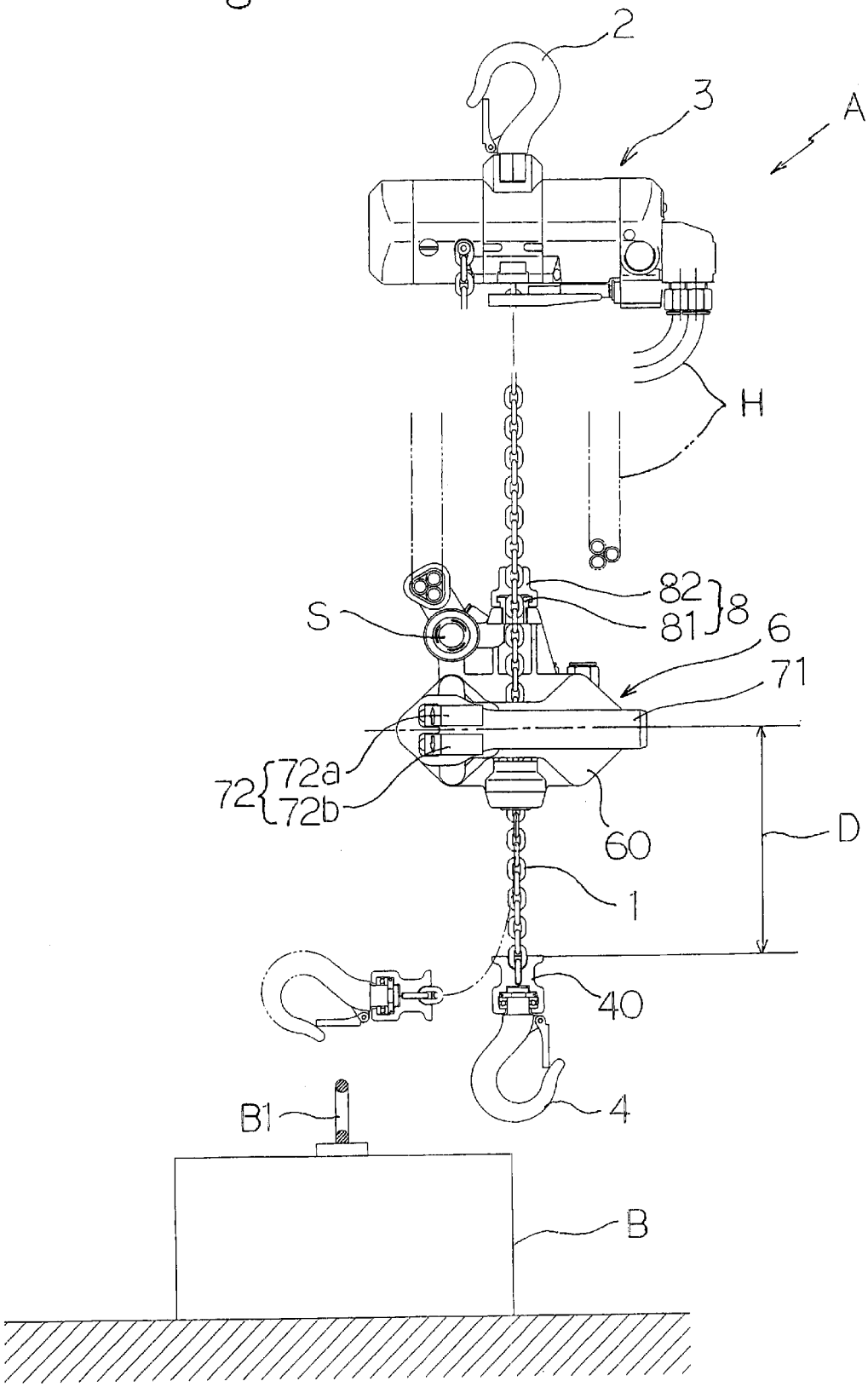
FIG. 1 is a schematic front illustration showing a hoist apparatus according to an embodiment of the present invention.

The hoist apparatus according to the present invention includes a hoist body member having a pneumatic motor and a chain-winding wheel member, such as a chain-winding toothed or polygonal wheel, rotatable by the pneumatic motor, a chain having a top end and a bottom end for hoisting an object, the chain being wound up or down at a top end portion by the chain-winding wheel member rotated by the pneumatic motor to raise or lower the object to a predetermined position, a lower hook member for hooking and hoisting the object, the lower hook member being secured to the bottom end of the chain, and a control unit for driving or suspending the operation of the pneumatic motor; wherein the control unit is detachably connected to the chain at the position apart from the hoist body member and close to the lower hook member; and wherein a distance of the chain between the control unit and the lower hook member is set to be variable.

The hoist apparatus may be coupled at its top end by a connecting member such as a hook member to an appropriate carrier or conveyor means for carrying or conveying an object. In this case, the carrier or conveyor means conveys the hoist apparatus to a desired position while the chain hoists the object in a suspended fashion.

The hoist apparatus according to the present invention is composed of the hoist body member and the control unit disposed discretely and apart therefrom. The hoist body member is provided with the pneumatic motor and the chain-winding wheel member rotatable in association with the operation of the pneumatic motor. The pneumatic motor may be operated by the supply of compressed air and rotated in a normal or opposite direction in association with a manner of the supply of the compressed air. As the compressed air is supplied to the pneumatic motor in one direction, e.g., in a normal direction, the pneumatic motor rotates the chain-winding wheel member in normal direction to wind the chain down. Conversely, as the compressed air is supplied to the pneumatic motor in another direction, e.g., in the opposite direction, the pneumatic motor rotates the chain-winding wheel member in the opposite direction to wind the chain up.

The chain may be connected at its top end to the hoist body member or any appropriate means and at its bottom end to the lower hook member for hooking the object. The chain is wound up or down, respectively, by the normal or opposite rotation of the chain-winding wheel member rotated by the pneumatic motor disposed in the hoist body member. The object hooked and hoisted by the lower hook member is raised or lowered by winding the chain up or down by the respective rotation of the chain-winding wheel member in association with the operation of the pneumatic motor. For instance, when the pneumatic motor rotates the chain-winding wheel member in a normal direction, on the one hand, the chain is wound up to raise the object, and when the pneumatic motor rotates the chain-winding wheel member in the opposite direction, on the other hand, the chain is wound down to lower the object. The chain may be of any shape or material as long as it can be engaged with the chain-winding wheel member that winds it up or down in a manner as described immediately hereinafter. On the other hand, the chain-winding wheel member may be in any shape as long as it can wind the chain up or down in the manner as will be described immediately hereinafter.

A portion of the chain wound up by the chain-winding wheel member is accommodated in a chain container disposed next or close to the hoist body member in a fashion in which it is loosely folded therein or part of the chain is superimposed over another part thereof, not in a fashion in which part thereof is wound over another part thereof about the chain-winding wheel member. This fashion of accommodation of the wound chain in the chain container allows the chain to be wound down and lowered at a constant speed over the entire length to a predetermined position as the pneumatic motor rotates the chain-winding wheel member in the given direction.

The lower hook member is connected to the bottom end of the chain so as to hook and hoist the object and the object is raised or lowered by winding the chain up or down in accordance with the operation of the control unit disposed discretely or apart from the hoist body member.

The control unit may include a control unit casing that is detachably secured to the chain at an appropriate position by means of a chain-connecting member so as to be slidable about the chain. The chain-connecting member may be integrally connected to the control unit casing so that the control unit casing can be coupled with the chain. The control unit casing is provided with a longitudinal bore that extends over the entire thickness at its generally central portion and the chain is located through the longitudinal bore. The configuration of the chain-connecting member may render it possible to secure the control unit to the chain at an appropriate position so that the location of its disposition can be readily changed in order to allow the operating person to operate the hoist apparatus without changing the operating position. This configuration further allows the control unit to be secured to the chain through the chain-connecting member so as to be slidable about the chain.

The control unit casing is further provided with an operational switch system that can control the operation of the pneumatic motor to raise and lower the chain. Moreover, the operational switch may be disposed exchangeably on the left-hand side or the right-hand side of the control unit casing so that the operating person can operate the hoist apparatus from either of the left-hand and right-hand sides of the control unit without operator changing the current operating position.

The hoist apparatus according to the present invention will be described in more detail with reference to the accompanying drawings.

FIG. 1 shows a hoist apparatus A according to the present invention that is designed as a compact and small-sized hoist machine. The hoist apparatus A may be configured to hoist an object having weight up to about 250 kilograms, although the maximum weight of the object is not limited to that weight and it may vary primarily with the kind of a material for the hoisting member. Further, the hoist apparatus A is arranged so as to adapt to conduct a series of continuous operations including raising, transferring horizontally, and lowering an object. A hoisting member for hoisting an object may include a chain that is highly durable.

As shown in FIG. 1, the hoist apparatus A comprises a chain 1, a hoist body member 3 connectable to and capable of being suspended by an upper hook member 2, a lower hook member 4 for hoisting an object, which is connected to the bottom of the chain 1, a pneumatic motor 5 (see FIG. 2), and a control unit 6. The chain 1 is wound up or down by the operation of the pneumatic motor 5 (see FIG. 2) disposed in a chamber of the hoist body member 3. The control unit 6 is mounted on the chain 1 in the position apart from the hoist body member 3 and on the side close to the lower hook member 4 and it can drive or suspend operations of the pneumatic motor 5. In FIG. 1, reference symbol H denotes an air hose disposed in the form of a coil around the chain 1 and connected to the hoist body member 3 at its one end and to the control unit 6 at the other end. Reference symbol B denotes an object to be hoisted by the hoist apparatus, and the object may be provided with an eyebolt B1 as a hoisting jig. Reference numeral 40 denotes a connecting jig for connecting the lower hook member 4 to the chain 1.

Figure 2:
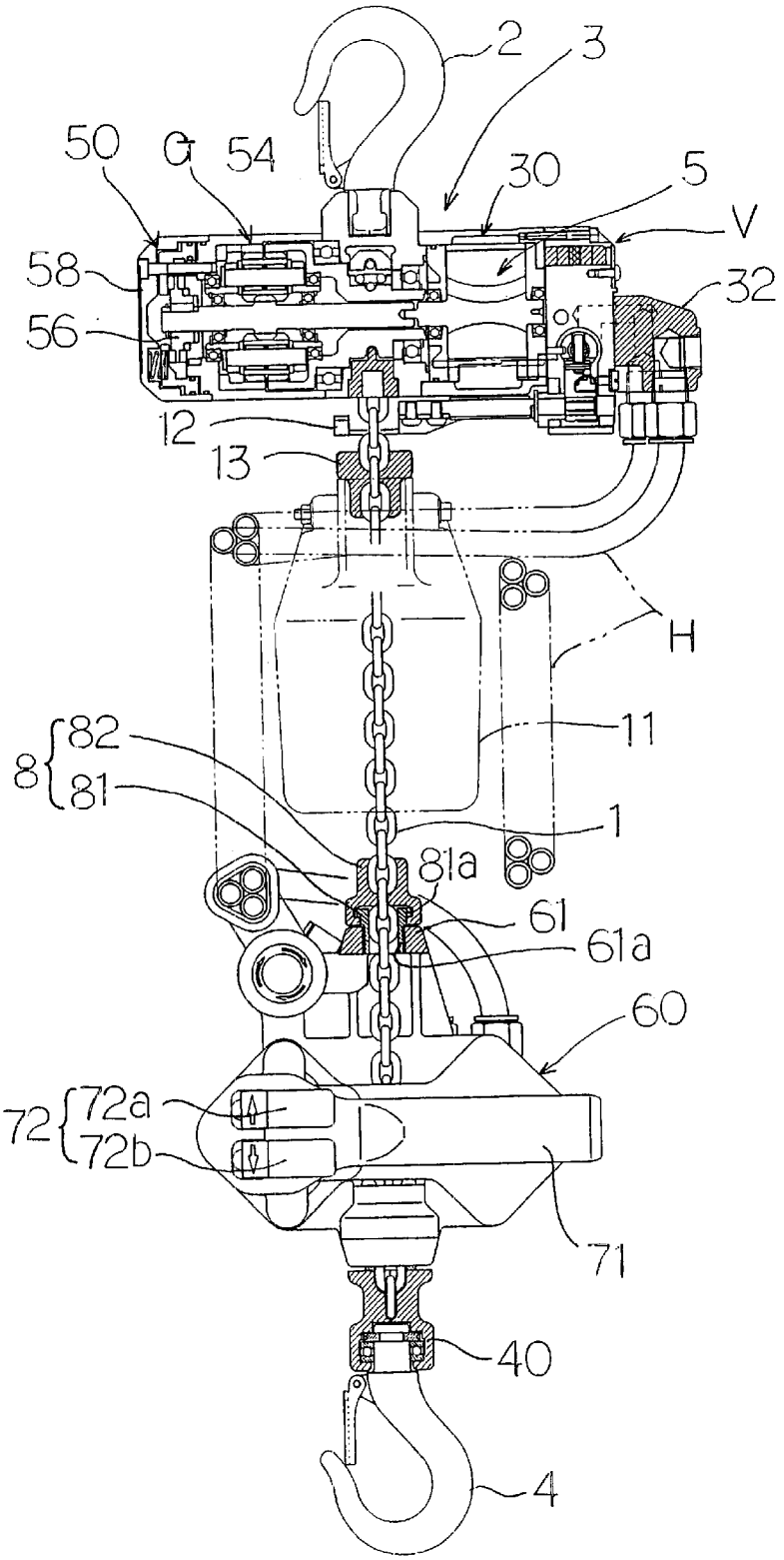
FIG. 2 is a partially sectional front view showing the hoist apparatus.
Figure 4:
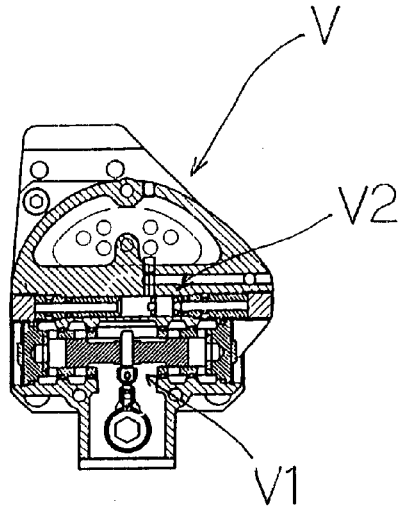
FIG. 4 is a sectional view showing a valve unit disposed in the hoist body member of the hoist apparatus.

As shown in FIG. 2, the hoist body member 3 constitutes a main body portion of the hoist apparatus, which is housed in a main body casing 30 and coupled with an air pump P (e.g. FIG. 6) through a port unit 32 having a connecting opening for connection with the hose H. It is disposed at the top end portion of the chain 1 and has the pneumatic motor 5 disposed in a motor chamber thereof. The pneumatic motor 5 is coupled with and associated with a chain-winding wheel member 31 for winding the chain up or down. The chain-winding wheel member 31 is drivable by the pneumatic motor 5 through a decelerating unit G. The hoist body member 3 is further provided with a braking mechanism system 50 and a valve unit V composed of a shift valve V1 for shifting a passage of compressed air and a brake valve V2 (see FIGS. 4, 6, and 7). The port unit 32 of the hoist body member 3 communicates with the air pump P, and the chain 1 can be raised or lowered by supplying compressed air to the pneumatic motor 5 from the pump by the operation of the control unit 6.

The hoist body member 3 will be described in more detail with reference to FIGS. 2, 6 and 7. The hoist body member 3 contains the pneumatic motor 5 that in turn is provided with a rotor 53 rotatable by means of compressed air supplied by the operation of the control unit 6. As the rotor 53 rotates, the chain-winding wheel member 31 rotates in a given direction for winding the chain 1 up or down. A pinion 54 is coupled wit the rotor 53 at one end thereof and mounted at the other end thereof to a brake disk 56 through a key 57, the brake disk 56 having a brake shoe 55 integrally mounted thereon. A face of the main body casing 30 at its one side end is used as a brake cover 58, and a brake piston 59 is interposed between the brake cover 58 and a gear case Gl of the decelerating unit G through a spring 91.

The chain 1 is vertically suspended downward from the hoist body member 3 and may be connected at its top end to the hoist body member 3 by any appropriate means and at its bottom end to the lower hook member 4 for hooking and hoisting the object. The top end of the chain 1 is bolted to the rear face of the main body casing 30 of the hoist body member 3. The bottom end of the chain 1 is coupled with the lower hook member 4 by means of the connecting jig 40 for hooking an object B with the hoisting jig, such as eyebolt B1, mounted thereon.

Figure 3:
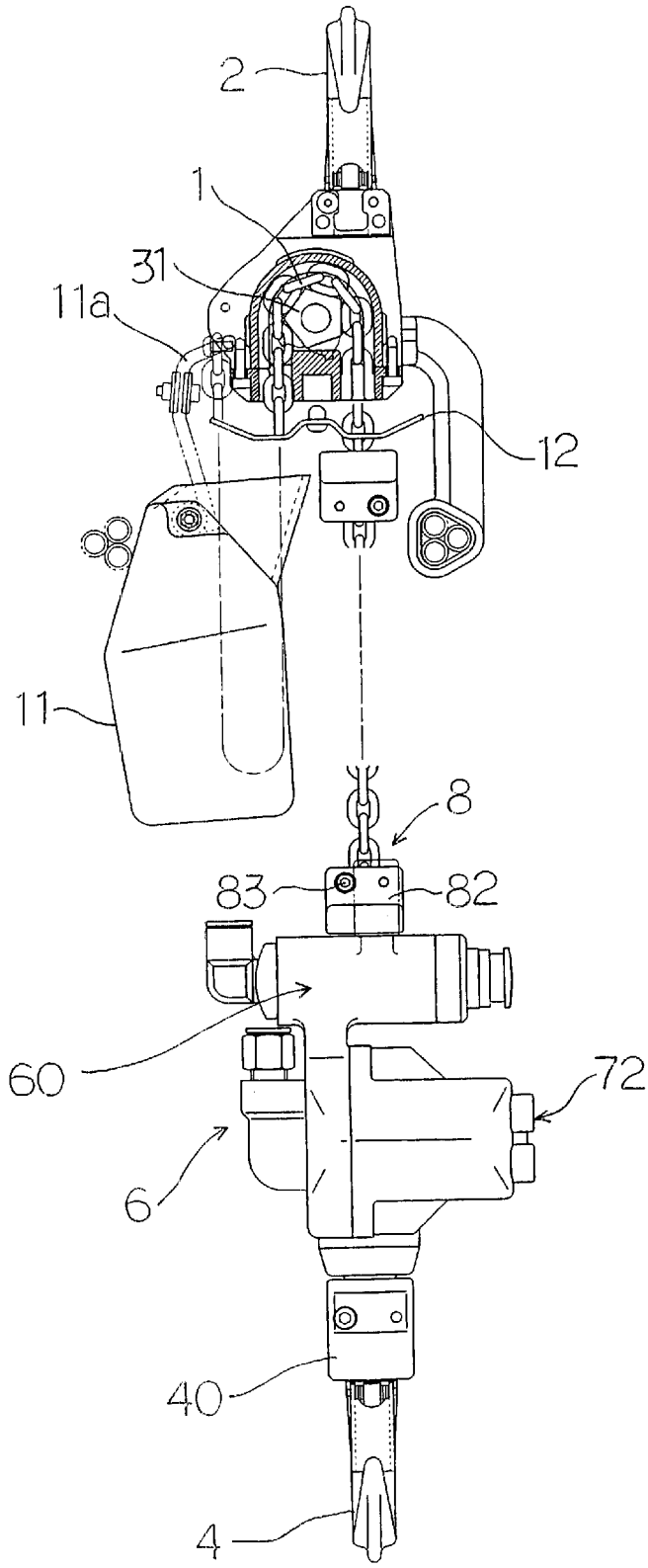
FIG. 3 is a partially sectional side view showing the hoist apparatus.

As shown in FIGS. 2 and 3, the chain 1 is wound up or down, respectively, by feeding upwardly or downwardly by means of the normal or opposite rotation of the chain-winding wheel member 31 rotatably driven by the pneumatic motor 5. More specifically, when the chain-winding wheel member 31 is rotated in a normal direction, on the one hand, the chain 1 is wound up to raise the object, and when the chain-winding wheel member 31 is rotated in the opposite direction, on the other hand, the chain 1 is wound down to lower the object. In other words, the object hooked and hoisted by the lower hook member 4 is raised or lowered by winding the chain 1 up or down by the respective rotation of the pneumatic motor 5.

As shown in FIGS. 2 and 3, a chain container 11 is disposed next or close to the hoist body member 3. A portion of the chain 1 wound up by the chain-winding wheel member 31 may be accommodated in the chain container 11 in a fashion in which it is loosely folded therein or part of the wound chain 1 is superimposed over another part thereof, not in a fashion in which the part thereof is wound over another part thereof about the chain-winding wheel member 31. The chain container 11 is connected to the main body casing 30 through a connecting member 11*a*. This fashion of accommodation of the wound chain 1 in the chain container allows the chain 1 to be wound down and lowered at a constant speed over the entire length to a predetermined position as the pneumatic motor 5 rotates the chain-winding wheel member 31 in the given direction.

Further, as shown in FIGS. 2 and 3, an air-passage blocking lever 12 is mounted to the hoist body member 3. As the chain is being wound up, the air passage is blocked by the action of the air-passage blocking lever 12 to stop the operation of the pneumatic motor 5 and prevent the chain 1 from being wound up too much as a stopper jig 13 abuts with the chain 1. The stopper jig 13 is mounted on the chain container 11 and disposed so as to abut with the chain 1 at its appropriate position. On the other hand, as the end portion of the chain 1 abuts with the stopper jig 13 when the chain 1 is wound down and lowered, the operation of the pneumatic motor 5 is stopped to prevent the further lowering of the chain 1.

As shown in FIGS. 2 and 3, the control unit 6 is detachably mounted on the chain 1 between the hoist body member 3 and the lower hook member 4, each connected to the chain 1, in a position discretely and separately from the hoist body member 3 and close to the lower hook member 4 by means of a chain-connecting jig 8 so as to be slidably movable around and along the chain 1. More specifically, the control unit 6 can be fixed to the chain 1 or detached therefrom by fastening or unfastening the chain-connecting jig 8, respectively, so as to set a length or distance D between the control unit 6 and the lower hook member 4. In other words, the above-mentioned configuration of the control unit 6 enables an easy change in the length or distance D of the chain 1 between the control unit 6 and the lower hook member 4 by fixing the control unit 6 to the chain 1 at an optional position.

Figure 5:
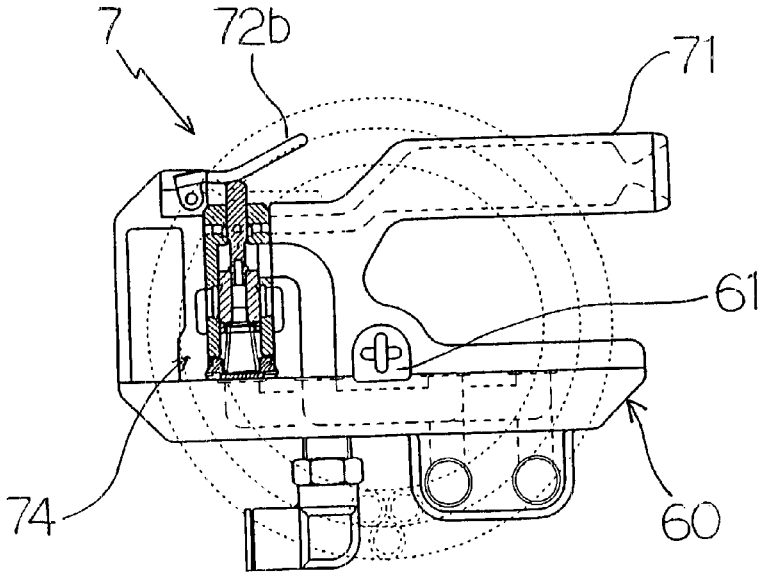
FIG. 5 is a schematic illustration showing an operational switch.

The control unit 6 comprises a control unit casing 60 and a ring-shaped section 61. The control unit casing 60 is provided with an operational switch system 7 at its outer front portion, which can control the operation of the pneumatic motor 5 to raise and lower the chain 1. The operational switch system 7 comprises a grip 71 and a switch lever 72, as shown in FIGS. 2 and 5. The ring-shaped section 61 is disposed on top of the control unit 6 at its generally central position so as to allow the chain 1 to be located and move therethrough and has a bore extending longitudinally over the entire thickness thereof, through which the chain 1 passes upwardly or downwardly. On top of the longitudinal bore thereof is disposed the chain-connecting jig 8.

The switch lever 72 of the control unit 6 comprises a raising lever 72*a* and a lowering lever 72*b*, which may be disposed in a vertically spaced relationship at a one portion of the grip 71. The operational switch system 7 may be disposed exchangeably on the left-hand side or the right-hand side at its outer front portion of the control unit casing 60 so that the operating person can operate the hoist apparatus from either of the left-hand and right-hand sides of the control unit 6 without the operator changing the current operating position.

More specifically, on the one hand, the raising lever 72*a* and the lower lever 72*b* of the switch lever 72 are detachably disposed vertically at the left-hand side end portion of the grip 71 so that the operator can readily operate the raising lever 72*a* and the lower lever 72*b* by the thumb of the right hand. As this location of the raising lever 72*a* and the lower lever 72*b* is not convenient for the operator to handle them by the left hand, however, the switch lever 72 can be changed so as to locate the raising lever 72*a* and the lower lever 72*b*in the opposite position, thereby enabling the operator to operate them readily by the left hand.

Figure 8:
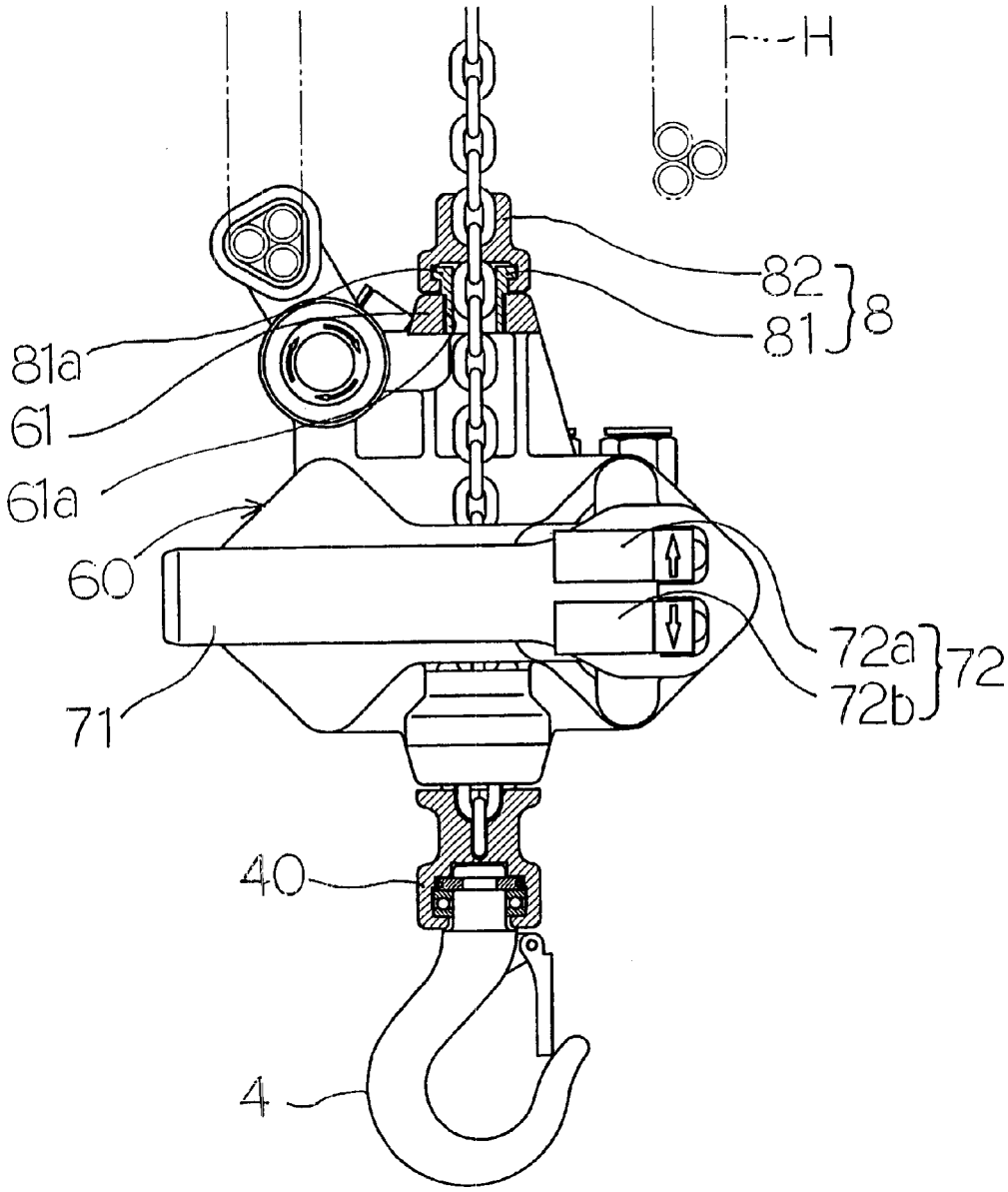
FIG. 8 is a schematic illustration showing an operational switch disposed at an opposite location.

As shown in FIG. 8, the chain-connecting jig 8 of the control unit casing 60 comprises a rotary hook member 81 and a rotary hanger 82. The rotary hook member 81 may be in a generally cylindrical form and be engaged with an inner peripheral face of an upper hole portion 61*a* of the ring-shaped section 61 so as to clamp the chain 1 located through the hole portion thereof. The rotary hanger 82 is engaged with a top flange portion 81*a* of the rotary hook member 81. The rotary hanger 82 comprises a housing formed by dividing a casing into two pieces and coupling the two pieces with each other detachably with a connecting bolt 83 and can be connected with the chain 1. On the other hand, the rotary hook member 81 is integrally connected to the control unit casing 60 in the manner as described above so as to slidably rotate around the inner peripheral face of the rotary hanger 82 connected and fixed to the chain 1, so that the control unit 6 can also be allowed to smoothly rotate around the chain 1. The smooth rotation of the control unit 6 around the chain 1 can provide great benefits particularly in operating the hoist apparatus because a twist of the chain 1 is recovered to its straight state once load is imposed thereon and the extending direction of the chain 1 is set to be straight downward.

Further, the above arrangement of the control unit 6 can couple the control unit casing 60 with the chain 1 at an optional location, thereby allowing an appropriate change of the length or distance D of the chain 1 between the control unit 6 and the lower hook member 4.

Therefore, as shown in FIG. 1, when the hoisting member, such as the eyebolt B1, to be mounted on a hoisting object is of a fixed type, on the one hand, the lower hook member 4 fixed to the chain 1 can be smoothly transferred, i.e., elongated or shortened, so as to be engaged with the eyebolt Bl. This can remarkably improve operability of the hoist apparatus.

On the other hand, when the hoisting jig to be mounted on the hoisting object is made of a flexible material, such as a wire or rope, the lower hook member 4 mounted on the chain 1 can be engaged with the hoisting jig by adjusting the position of the rotary hanger 82 and elongating or shortening the distance D between the lower hook member 4 and the control unit 6. The position of the rotary hanger 82 can be adjusted by operating the switch lever 72 by hand, and the control unit 6 can be engaged with the lower hook member 4 while operating the switch lever 72. This can also serve as improving operability of the hoist apparatus because the lower hook member 4 can be engaged with the hoisting jig by a one-hand operation.

As described above, the use of the chain 1 as the hoisting member serves as extending the life of the hoist apparatus because it has a longer life than other hoisting members such as a wire or rope. Further, the use of the chain 1 offers the benefits that the chain can be pulled up and transferred into the chain container 11 by the action of the chain-winding wheel member 31 and it is then stored therein in a folded manner without being wound about the chain-winding wheel member 31. Therefore, the chain 1 can be pulled up and down at a constant speed at any optional winding position of the chain 1 because the chain-winding wheel member 31 can feed the chain 1 at an identical speed.

Moreover, the lift height for hoisting the object can be set at any desired height.

Furthermore, the configuration of the pneumatic hoist apparatus according to the present invention presents the advantages that the operator is not or little bothered by exhaust gases discharged from the pneumatic motor 5 and noises generated thereby, because the hoist body member 3 can be located at the position close to the upper hook member 2 and apart from the operating position of the operator so that exhaust gases discharged from the pneumatic motor 5 do not hit the operator and are discharged at the position remote from the operating position of the operator.

Figure 6:
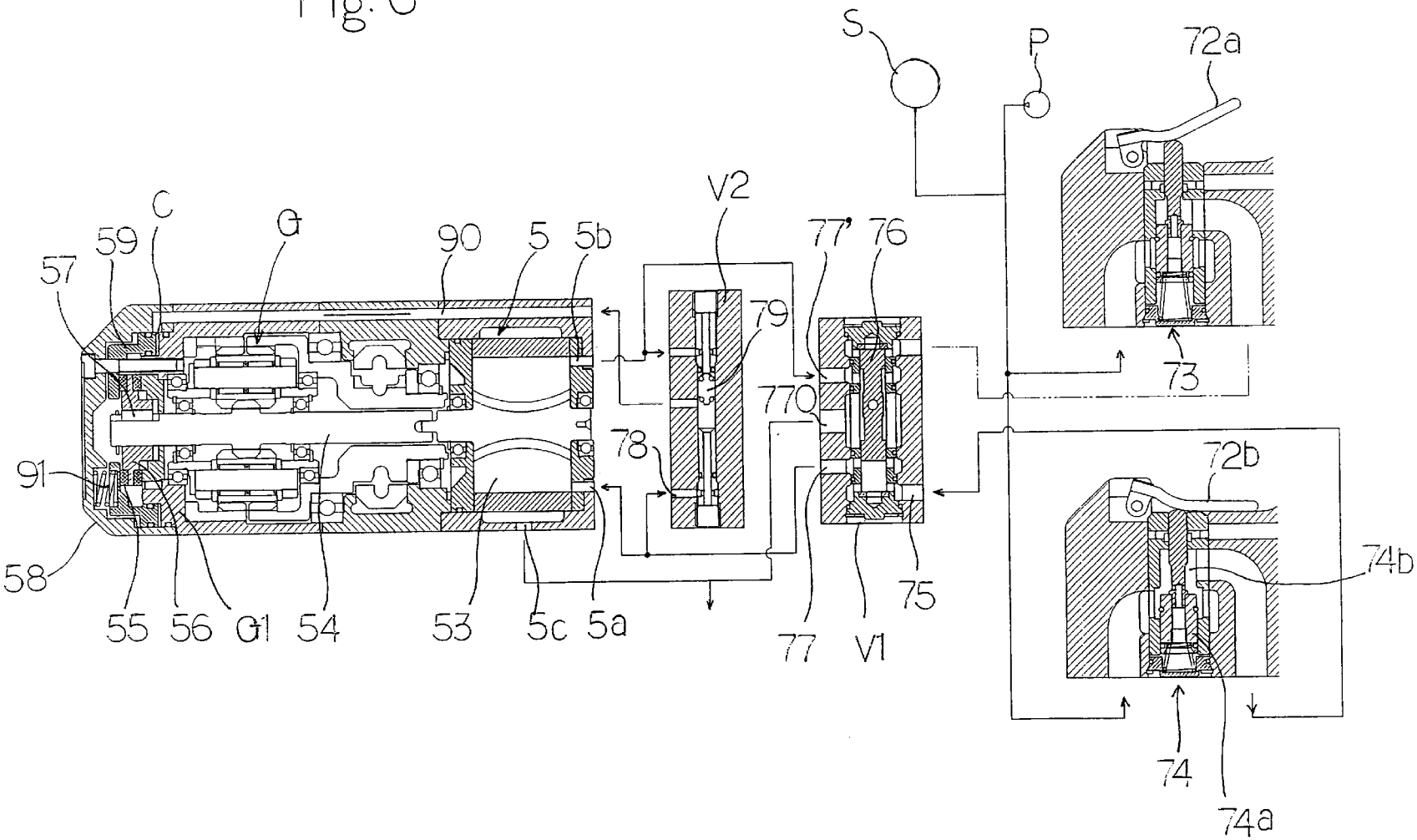
FIG. 6 is a schematic illustration showing a flow of compressed air in the hoist apparatus when the chain is lowered.
Figure 7:
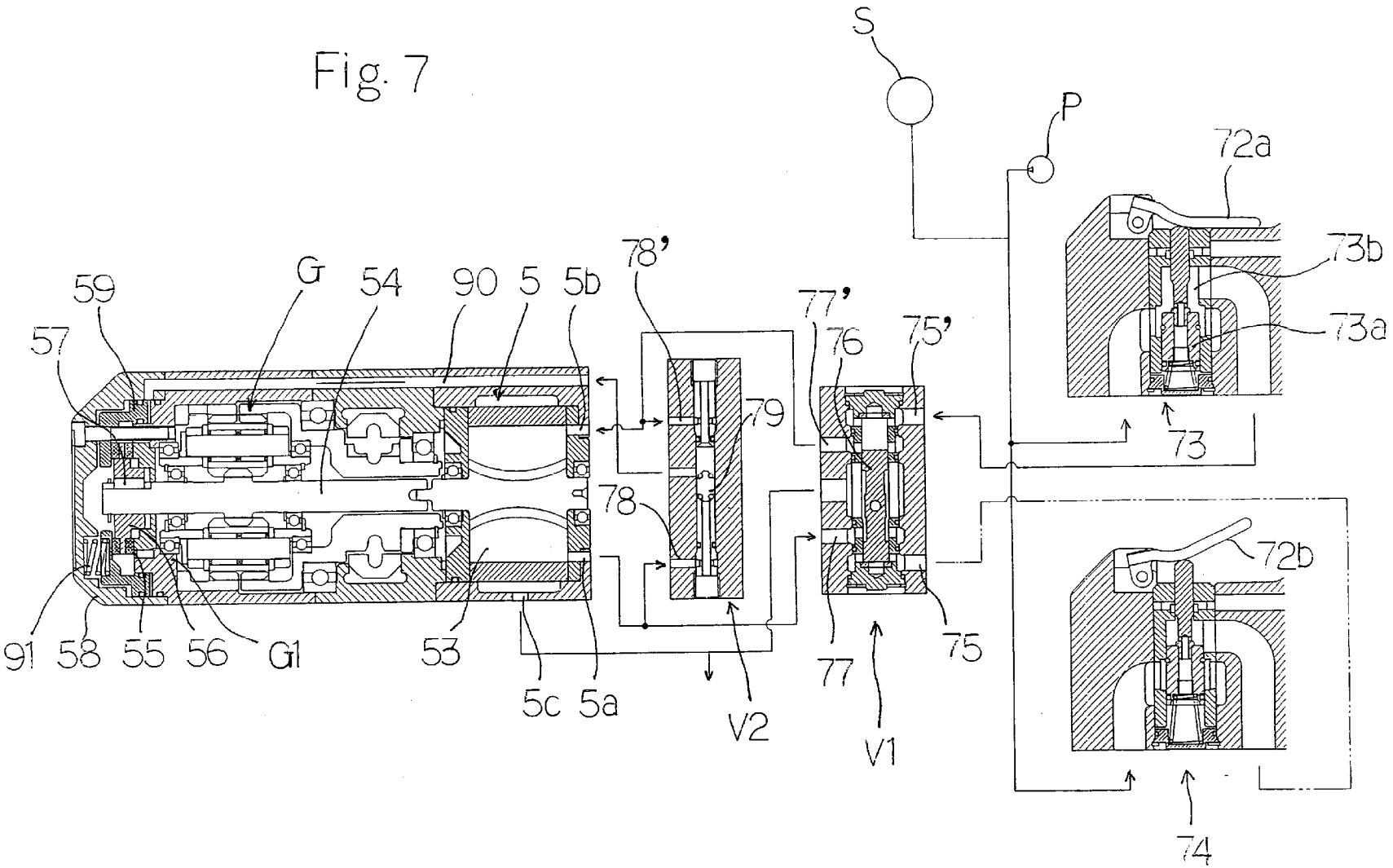
FIG. 7 is a schematic illustration showing a flow of compressed air in the hoist apparatus when the chain is raised.

Now, a description will be specifically given regarding the operation of the hoist apparatus A according to one embodiment of the present invention with reference to FIGS. 6 and 7.

Upon operating the raising lever 72*a* or the lowering lever 72*b* of the switch lever 72, compressed air is supplied from the air pump P to the pneumatic motor 5 to rotate the chain-winding wheel member 31 of the hoist body member 3 and to wind the chain 1 down or up.

As the lowering lever 72*b* is depressed for lowering the chain 1 as shown in FIG. 6, the compressed air flows from the air pump P and then presses downwardly a valve member 74*a* of a lowering valve 74 of the lowering lever 72*b* and opens a path 74*b* to allow passage of the compressed air to the shift valve V1. The compressed air passed through the path 74*b* enters an inlet 75 of the shift valve V1 and forces a main spool 76 disposed in a main spool chamber thereof toward one side to allow the passage of the compressed air to an opening 77 that in turn communicates with the brake valve V2 and with the motor chamber of the hoist body member 3 in which the pneumatic motor 5 is disposed. The main spool 76 is biased at a neutral position by a spring in the shift valve V1.

A portion of the compressed air passed through the opening 77 of the shift valve V1 then enters into the chamber for the pneumatic motor 5 through a first opening 5*a* disposed on a side wall of the hoist body member 3, thereby allowing the rotor 53 to generate rotational torque for rotating the chain-winding wheel member 31.

On the other hand, another portion of the compressed air fed from the opening 77 of the shift valve V1 enters into an inlet 78 of the brake valve V2. It then presses a shuttle valve 79 disposed in a shuttle valve chamber toward one side to allow communication of the inlet 78 with an outlet of the brake valve V2 to allow the compressed air to flow into and through a braking passage 90 of the hoist body member 3. The braking passage 90 communicates with an air chamber C interposed between the brake piston 59 and the gear case G1 of the decelerating unit G. The brake piston 59 is biased toward the brake disk 56 by a spring 91 connected to an inner wall surface of the brake cover 58.

Then, the compressed air flown through the braking passage 90 enters into the air chamber C to raise the pressure within the chamber C. As the pressure within the chamber C is raised, the compressed air presses the brake piston 59 toward the brake cover 58 in resistance to a spring 91 that biases the brake piston 59 to reduce braking torque of the brake disk 56. As the rotational torque of the rotor 53 becomes larger than the braking torque of the brake disk 56, then the pneumatic motor 5 is rotated to lower the chain 1 in a downward direction.

After driving the rotor 53, the compressed air is discharged outside through an intermediate exhaust outlet 5*c* of the pneumatic motor chamber. Moreover, the compressed air is also discharged from a second opening 5*b* of the pneumatic motor chamber to an opening 77' of the shift valve V1. Once the compressed air enters into the opening 77', the opening is allowed to communicate with an outlet 770 through a communicating passage formed within the main spool chamber of the shift valve V1.

Now, a detailed description will be given regarding the operation of the raising valve 73 for raising the chain 1 with reference to FIG. 7 illustrating an embodiment of the hoist apparatus according to the present invention when the raising lever 72*a* is operated.

As the raising lever 72*a* is depressed, the compressed air flows from the air pump P into the raising valve 73 to open a valve member 73*a* to allow passage of the compressed air into an air passage 73*b* communicating with an inlet 75' of the shift valve V1. The compressed air flown from the air passage 73*b* enters the shift valve V1 through an inlet 75' disposed therein and presses the main spool 76 toward the other side, i.e., in a downward direction when looked at the drawing, to allow communication with the opening 77'.

A portion of the compressed air flown through the opening 77' then enters through the second opening 5*b* into the pneumatic motor chamber to rotate the pneumatic motor 5 in the direction opposite to the direction when the compressed air enters through the first opening 5*a* when the lowering lever 72*b* is operated. After rotating the pneumatic motor 5, the compressed air is then discharged from the pneumatic motor chamber through the first opening 5*a*. The compressed air discharged through the first opening 5*a* is then led to the inlet 78 of the brake valve V2 and to the opening 77 of the shift valve V1. The compressed air entered into the brake valve V2 then pushes the shuttle valve 79 to communicate the inlet 78 with the outlet communicating with the braking passage 90. Moreover, the compressed air passed through the opening 77 pushes the main spool 76 to communicate the opening 77 with the outlet 770 to allow the air to be discharged outside. On the other hand, the rest of the compressed air within the pneumatic motor chamber is discharged outside through the exhaust outlet 5*c*.

Another portion of the compressed air passed through the opening 77' enters through the opening 78' of the brake valve V2 and pushes the shuttle valve 79 downward to communicate the opening 78' with the outlet connected to the braking passage 90.

The compressed air passed through the braking passage 90 acts in the same manner as described above. When the braking torque of the brake disk 56 is larger than the rotational torque of the rotor 53, the pneumatic motor rotates to raise or wind the chain 1 up.

As the depressing of each of the raising lever 72*a* and the lowering lever 72*b* was ceased, the lever is returned to its suspended position and all the compressed air within the pneumatic motor 5 is discharged from the pneumatic motor chamber. At the same time, the compressed air present in the chamber C is also discharged to return the pressure therein to ambient pressure. This causes the brake disk 56 to stay in a released status by means of the biasing force of the spring 91, thereby suspending the movement of the chain 1 in a position between the brake piston 59 and the gear case G1.

A line extending from the air pump P to the shift valve V1 may be provided with an emergency stop switch S to block the air passage from the air pump P to the operational switch system 7 upon emergency. The depressing of the emergency stop switch S can suspend the movement of the chain 1 even if the chain 1 is being raised or lowered.

EFFECTS OF THE INVENTION

The hoist apparatus according to the present invention has the control unit disposed discretely or apart from the hoist body member with the pneumatic motor disposed therein in such a manner that the control unit can optionally change its position of the chain hoisting the object. This configuration of the hoist apparatus provides the advantage that the operation for hooking and hoisting the object can be carried out readily because the operator can work at the position close to the chain. Moreover, as the distance of the chain between the control unit and the lower hook member for hooking and hoisting the object can be changed in a variable fashion, the lower hook member can be adapted to the position of the object to be hooked and hoisted thereby or released therefrom even if the position of the lower hook member would not fit the position of the object exactly. This naturally leads to remarkable improvements in operability of the hoist apparatus.

Further, the hoist apparatus according to the present invention can provide the advantage that the lower hook member can be adapted to any object-hoisting jig to be hooked and hoisted by the lower hook member, whether it is of a flexible type or of a fixed type. For instance, when the object-hoisting jig of a flexible type such as a wire or rope is used, the hooking operation for hooking the object on the hook can be readily carried out only by one hand without the operator releasing the other hand from the control unit. On the other hand, even when the object-hoisting jig of a fixed type, such as an eyebolt, is used, the lower hook member can adapt its position to the position of the object-hoisting jig mounted on the object to be hooked and hoisted by the lower hook member, for instance, by turning the hook sideways. This can also improve operability of the hoist apparatus remarkably.

Moreover, the hoist apparatus of this invention uses the chain as a hoisting member, which is more durable than a flexible hoisting member such as a rope, so that the life of the hoisting member can be rendered longer. The use of the chain as a hoisting member in association with the chain-winding toothed or polygonal wheel as a chain-winding wheel member enables accommodation of the wound portion of the chain in the chain chamber in a loosely folded or looped fashion, not in a fashion such that it is wound about a chain-winding means. This also allows the chain to be wound up or down to a predetermined position at a constant speed, leading to improvements in hoisting operability by the hoist apparatus.

For the hoist apparatus of this invention, no exhaust gases discharged from the hoist body member hit the operator directly because the exhaust outlets are provided in the hoist body member that is disposed discretely and apart from the control unit operated by the operator. Likewise, this can reduce the level of noise imposed directly on the operator because the operator is working at a place apart from the hoist body member of the hoist apparatus. As a matter of course, this can serve as remarkably improving working conditions for the operator.

Furthermore, the hoist apparatus according to the present invention has the control unit disposed so as to be slidable about the chain so that the position of the control unit can be changed as the control unit blocks the hooking and hoisting of the object by the lower hook member.

In addition, the operational switch system for the control unit is exchangeably disposed on the left-hand side and the right-hand side so that the operator can operate the chain from either of the left-hand side and the right-hand side of the control unit. This also serves as improving workability of the hoist apparatus.

What is claimed is:

1. A hoist apparatus comprising:

a chain having a top end and a bottom end for hoisting an object;

a hoist body member connected to said upper hook member in a suspending manner and the top end of said chain being connected to said hoist body member;

a lower hook member for hoisting said object connected to the bottom end of said chain;

a pneumatic motor disposed in said hoist body member;

a chain-winding member rotatable by said pneumatic motor for winding said chain up and down, said chain-winding member being coupled with said pneumatic motor; and a control unit for controlling the operation of said pneumatic motor, said control unit being disposed on said chain in a position apart from said hoist body member and close to said lower hook member;

wherein a distance of said chain between said control unit and said lower hook member is set to be variable.

2. The hoist apparatus as claimed in claim 1, wherein said control unit is mounted so as to rotate about said chain.

3. The hoist apparatus as claimed in claim 1, further comprising an operational switch system disposed in said control unit and arranged so as to change a location at an opposite side.

4. The hoist apparatus as claimed in claim 3, wherein:

said operational switch system comprises a chain-raising lever and a chain-lowering lever;

said chain-raising lever is disposed for raising said chain by depressing said chain-raising lever; and said chain-lowering lever is disposed for lowering said chain by depressing said chain-lowering lever.

5. The hoist apparatus as claimed in claim 4, wherein:

said chain-raising lever member is disposed so as to allow compressed air to drive said pneumatic motor in one direction and said chain-lowering lever member is disposed to allow compressed air to drive said pneumatic motor in the opposite direction; and said pneumatic motor driven in one direction rotates said chain-winding member in the direction in which said chain is wound up and said pneumatic motor driven in the opposite direction rotates said chain-winding member in the direction in which said chain is wound down.

6. The hoist apparatus as claimed in claim 1, further comprising a chain container in which a portion of said chain is accommodated in a folded manner as said chain is wound up.

7. The hoist apparatus as claimed in claims 4 wherein:

said chain is wound up to raise said object by rotating said pneumatic motor in one direction by supplying compressed air to said pneumatic motor by depressing said chain-raising lever; and said chain is wound down to lower said object by rotating said pneumatic motor in the opposite direction by supplying compressed air to said pneumatic motor by depressing said chain-lowering lever.

* * * * *